US006340327B1

(12) United States Patent
Afif

(10) Patent No.: US 6,340,327 B1
(45) Date of Patent: Jan. 22, 2002

(54) WAFER POLISHING APPARATUS AND PROCESS

(75) Inventor: Samir A. Afif, Alburtis, PA (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/419,259

(22) Filed: Oct. 15, 1999

(51) Int. Cl.[7] ..... B24B 21/18; B24B 33/00
(52) U.S. Cl. ..... 451/444; 451/287
(58) Field of Search ..... 451/41, 56, 60, 451/63, 65, 57, 259, 285, 287, 288, 443, 444, 446, 453, 451

(56) References Cited

U.S. PATENT DOCUMENTS 5,645,682 A * 7/1997 Skrovan ..... 451/56
5,651,725 A * 7/1997 Kikuta et al. ..... 451/444
5,707,274 A * 1/1998 Kim et al. ..... 451/289
5,785,585 A * 7/1998 Manfredi et al. ..... 451/289
6,039,635 A * 3/2000 Mitsuhashi et al. ..... 451/443
6,135,868 A * 10/2000 Brown et al. ..... 451/444
6,149,508 A * 11/2000 Vanell et al. ..... 451/444

OTHER PUBLICATIONS 2 sample pages from Logitech Ltd. catalog, date unknown.

* cited by examiner

*Primary Examiner*—Derris H. Banks
(74) *Attorney, Agent, or Firm*—Duane, Morris & Heckscher LLP

(57) ABSTRACT

An apparatus and method for polishing a workpiece including a polishing pad; at least one polishing arm for holding a workpiece to be polished on the polishing pad; at least one conditioning arm for conditioning the polishing pad; and, a slurry dispenser. The slurry dispenser is disposed between the at least one polishing arm and the at least one conditioning arm so that slurry dispensed by the slurry dispenser contacts the at least one conditioning pad before it contacts the at least one polishing pad.

6 Claims, 6 Drawing Sheets

WAFER POLISHING APPARATUS AND PROCESS

FIELD OF THE INVENTION

The present invention relates to fabrication of semiconductor devices, and in particular, to a method and apparatus for polishing semiconductor wafers.

DESCRIPTION OF THE RELATED ART

Chemical mechanical planarization ("CMP") processes remove material from the surface of a semiconductor wafer in the production of ultra-high density integrated circuits. In a typical CMP process, a wafer is pressed against a polishing pad in the presence of a slurry under controlled chemical, pressure, velocity, and temperature conditions. The slurry solution generally contains small, abrasive particles that abrade the surface of the wafer, and chemicals that etch and/or oxidize the surface of the wafer. The polishing pad is generally a planar pad made from a relatively soft, porous material such as polyurethane. Thus, when the pad and/or the wafer moves with respect to the other, material is removed from the surface of the wafer by the abrasive particles (mechanical removal) and by the chemicals (chemical removal) in the slurry.

FIGS. 1 and 2 show a conventional polishing apparatus 10. The apparatus 10 includes a polishing pad 20 and three polishing stations 30, 40, 50 for polishing semiconductor wafers 60. Preferably, the polishing pad 20 spins counter-clockwise to accomplish the polishing of the wafers 60, as shown by directional arrow A in FIG. 2. Each station 30, 40, 50 includes a polishing arm 31, 41, 51 which holds the wafers 60 during the polishing process. Each polishing arm 31, 41, 51 includes a U-shaped member for holding vacuum chucks 32, 42, 52. Each polishing arm 31, 41, 51 includes one such vacuum chuck 32, 42, 52. The vacuum chucks 32, 42, 52 are coupled to U-shaped members through bearings 35, 45, 55. The bearings 35, 45, 55 allow the vacuum chucks 32, 42, 52 to rotate with respect to the respective polishing arms 31, 41, 51. The vacuum chucks 32, 42, 52 operate to hold the wafers 60 during the polishing process. Each of the vacuum chucks 32, 42, 52 includes an upper end 33, 43, 53 which may be coupled to a vacuum device (not shown) to provide a vacuum to the vacuum chucks. As can be clearly seen in FIG. 1, in the conventional polishing apparatus 10, the polishing stations 30, 40 each hold wafers 60, while the polishing station 50 is left empty (i.e. no wafer 60 is polished there). The polishing apparatus 10 also includes a slurry dispenser 70 which produces slurry which is dispensed onto a top surface 21 of the polishing pad 20.

A problem associated with the conventional apparatus 10 discussed above is that the slurry dispensed from slurry dispenser 70 often gathers in clumps on the top surface 21 of the polishing pad 20. Since the slurry is dispensed from the slurry dispenser 70 in droplet form, when the droplets hit the rotating polishing pad 20 they stay in droplet form and do not spread out. This clumping of the slurry results in uneven polishing of the wafers 60. In particular, when a droplet of slurry contacts a wafer 60, the initial area of the wafer that the slurry contacts is polished down further than the other areas of the wafer.

Therefore, there is currently a need for an improved polishing apparatus which provides an even distribution of slurry.

SUMMARY OF THE INVENTION

The present invention is an apparatus and method for polishing a workpiece including, a polishing pad; at least one polishing arm for holding a workpiece to be polished on the polishing pad; at least one conditioning arm for conditioning the polishing pad; and, a slurry-producing device, the slurry-producing device being disposed between the at least one polishing arm and the at least one conditioning arm so that slurry dispensed by the slurry-producing device contacts the at least one conditioning pad before it contacts the at least one polishing pad.

The above and other advantages and features of the present invention will be better understood from the following detailed description of the preferred embodiments of the invention which is provided in connection with the accompanying drawings.

DETAILED DESCRIPTION

Figure 1:
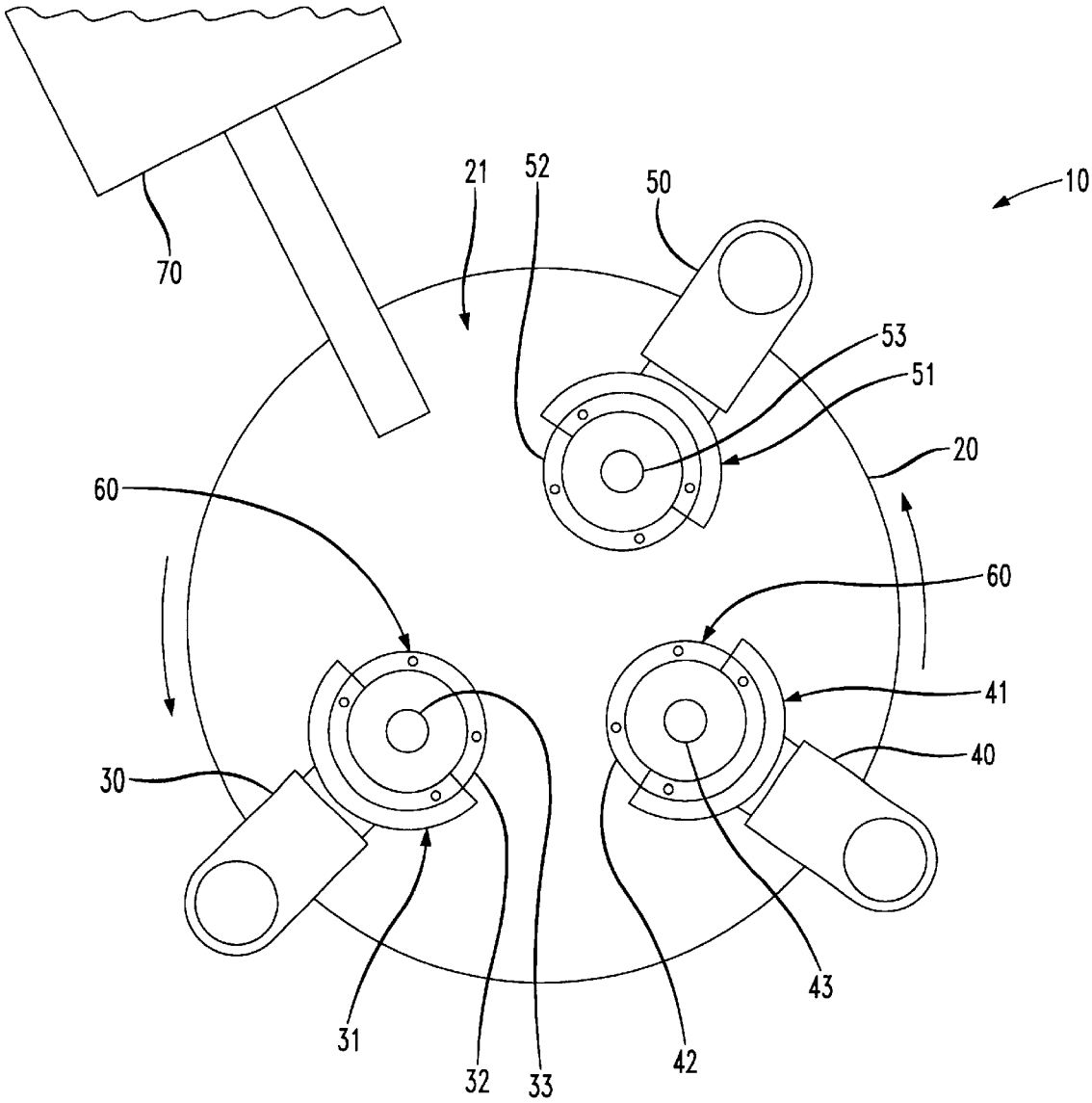
FIG. 1 PRIOR ART
FIG. 1 is a top plan view of a conventional polishing apparatus.
Figure 2:
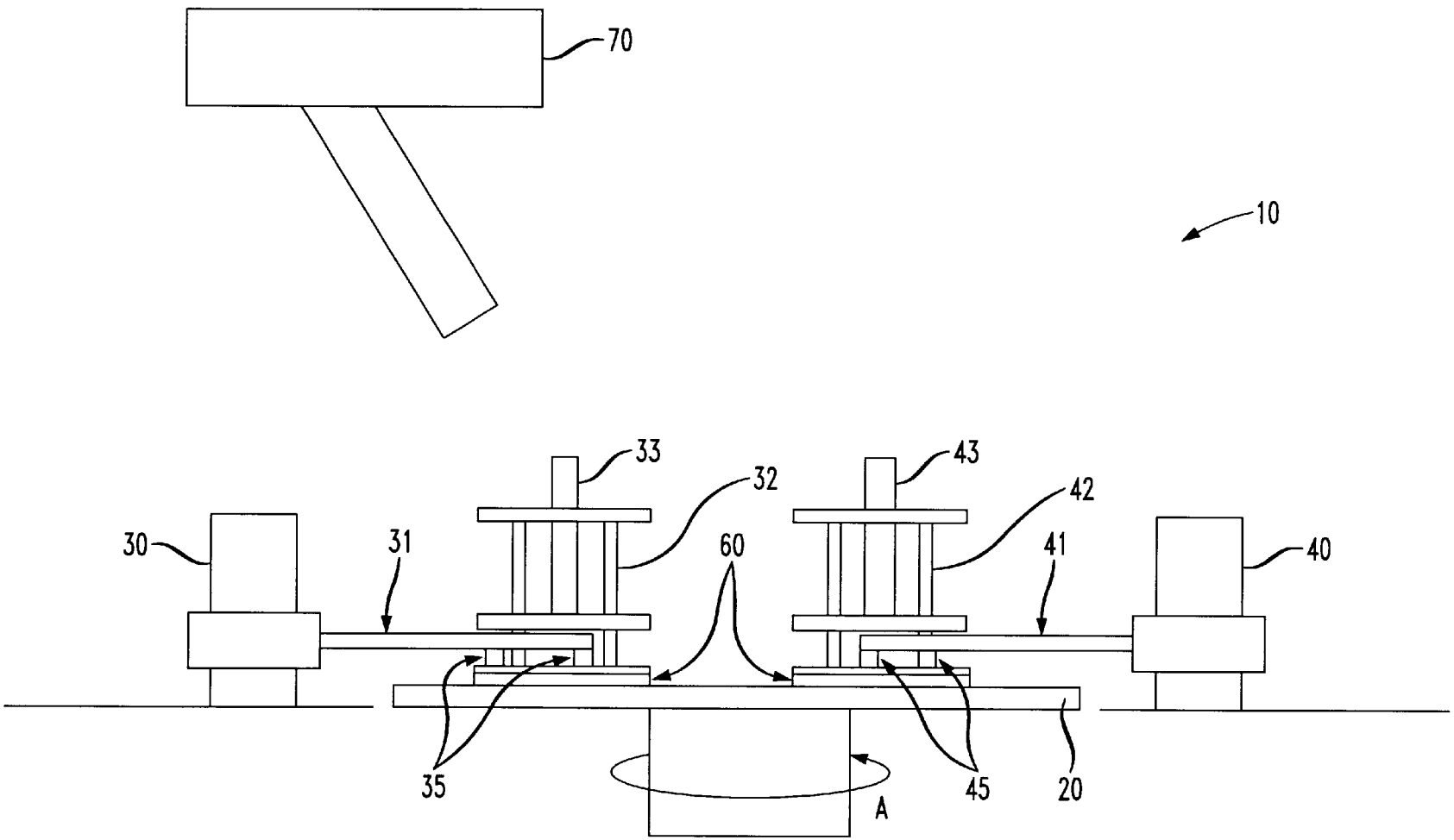
FIG. 2 PRIOR ART
FIG. 2 is a side elevation view of the conventional polishing apparatus shown in FIG. 1.
Figure 3:
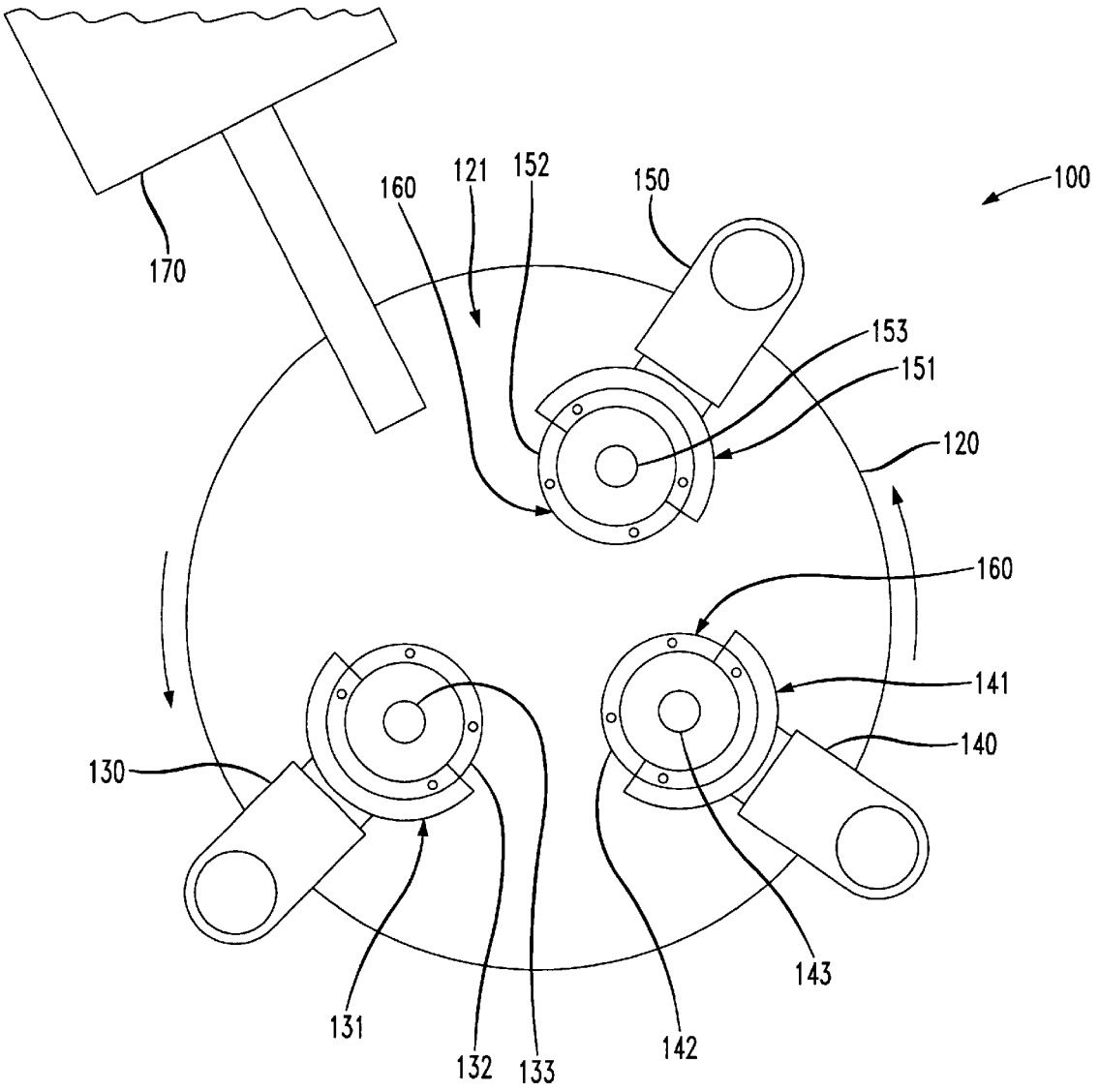
FIG. 3 is a top plan view of a polishing apparatus according to the exemplary embodiment of the present invention.
Figure 4:
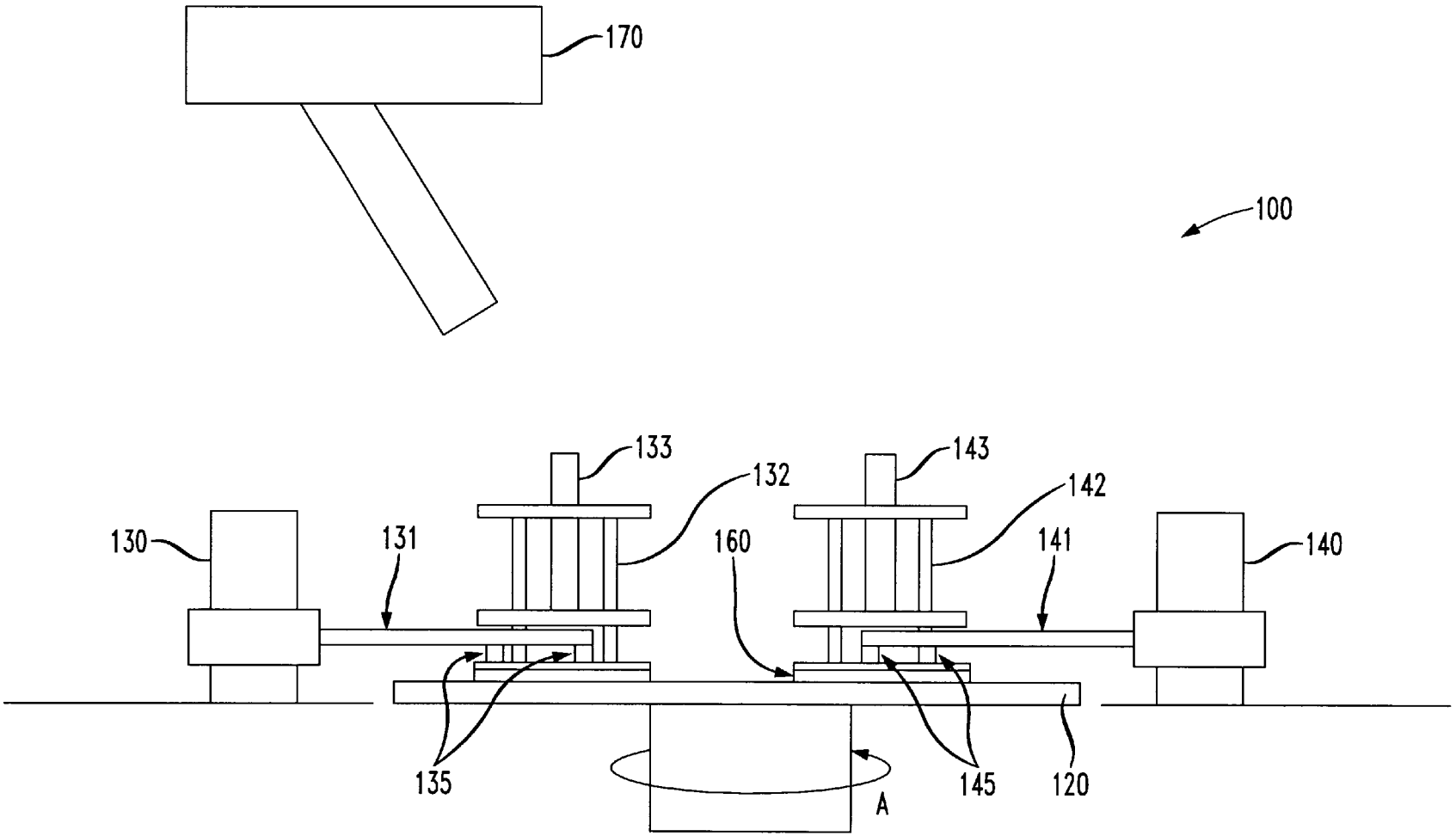
FIG. 4 is a side elevation view of the polishing apparatus shown in FIG. 3.

Referring to FIGS. 3 and 4, there is shown a polishing apparatus 100 according to an exemplary embodiment of the present invention. The apparatus 100 includes a polishing pad 120 and a conditioning station 130 for conditioning the polishing pad 120, and two polishing stations 140, 150 for polishing semiconductor wafers 160. In the exemplary embodiment, the polishing pad 120 rotates counter-clockwise to accomplish a polishing of the wafers 160, as shown by directional arrow A in FIG. 4. The polishing pad 120 may be substantially circular, as shown in FIG. 3, or may be of any other suitable shape known to those skilled in the art. Further, the conditioning station 130 and the polishing stations 140, 150 may be disposed at different radial positions about the periphery of the polishing pad 120, as shown in FIG. 3. The conditioning station 130 includes an arm 131 for conditioning the surface of the polishing pad by spreading out a slurry which becomes disposed on a top surface of the polishing pad 120, as explained below. The polishing stations 140, 150 each include an arm 141, 151 with a U-shaped member which holds respective vacuum chucks 142, 152. The conditioning station 130 also includes an arm 131 with a U-shaped member which holds a vacuum chuck 132. The vacuum chucks 132, 142, 152 are coupled to the respective arms 131, 141, 151 through bearings 135, 145, 155, which are preferably made of plastic, but may also be made of metal. The bearings 135, 145, 155 allow the vacuum chucks 132, 142, 152 to rotate with respect to the respective polishing arms 131, 141, 151. As can be clearly seen in FIG. 2, in the exemplary polishing apparatus 100, the polishing stations 140, 150 each hold wafers 160, while the conditioning station 130 is left empty (i.e. no wafer 60 is polished there). In the exemplary polishing apparatus 100, the vacuum chucks 142, 152 operate to hold the wafers 160 during the polishing process, and the vacuum chuck 132 operates to condition the surface of the polishing pad 120.

Each of the vacuum chucks 132, 142, 152 includes an upper end 133, 143, 153 which may be coupled to a vacuum device (not shown) to provide a vacuum to the vacuum chucks. In the exemplary polishing apparatus 100, although all three vacuum chucks 132, 142, 152 may be coupled to a vacuum device, vacuum chuck 132 has no vacuum applied thereto, as it is used only for conditioning and not for holding a wafer 160. The polishing apparatus 100 also includes a slurry dispenser 170 which produces slurry which is dispensed onto a top surface 121 of the polishing pad 120.

Figure 5:
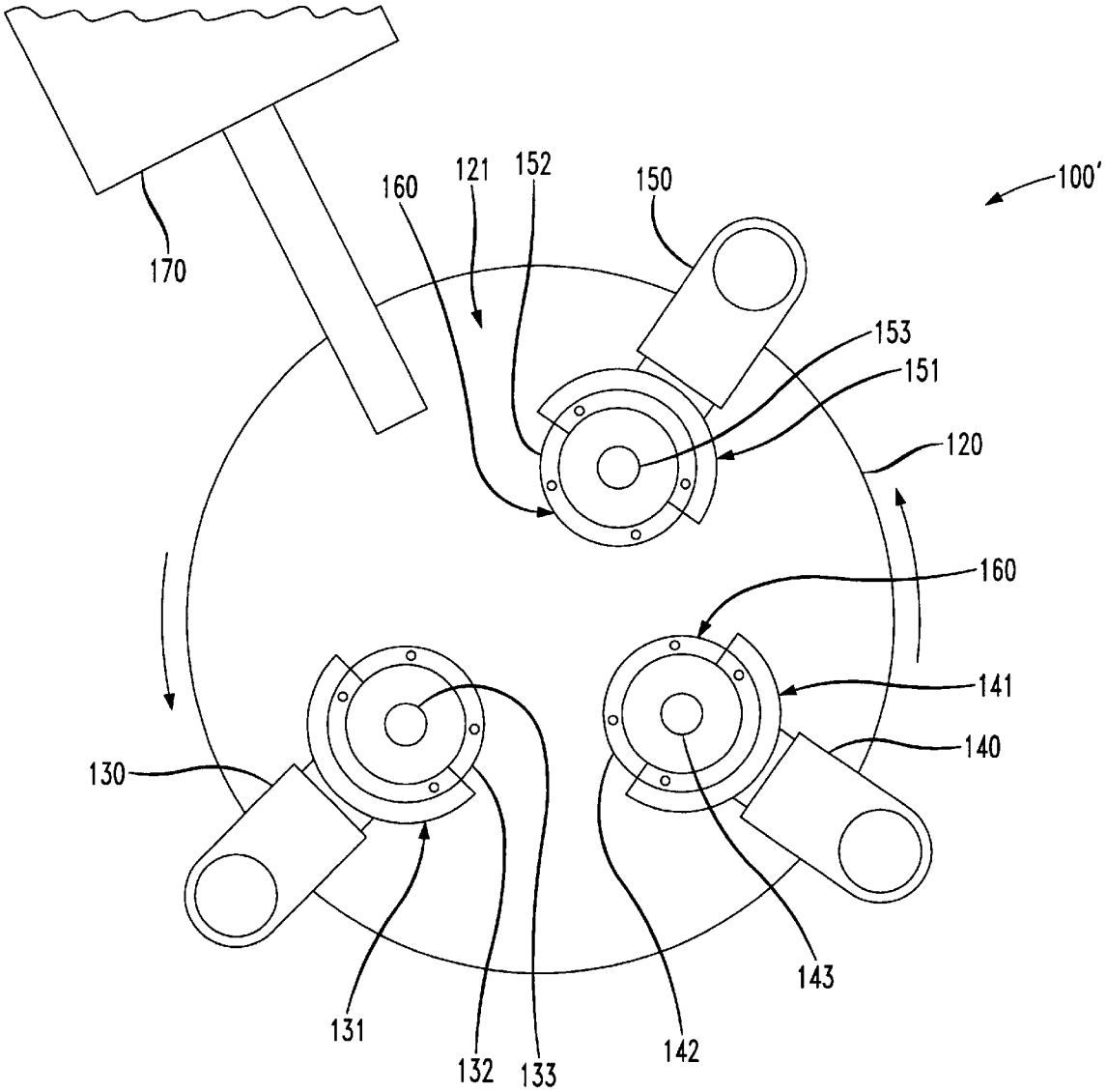
FIG. 5 shows a top plan view of the polishing apparatus of FIG. 3, including a conditioning pad.
Figure 6:
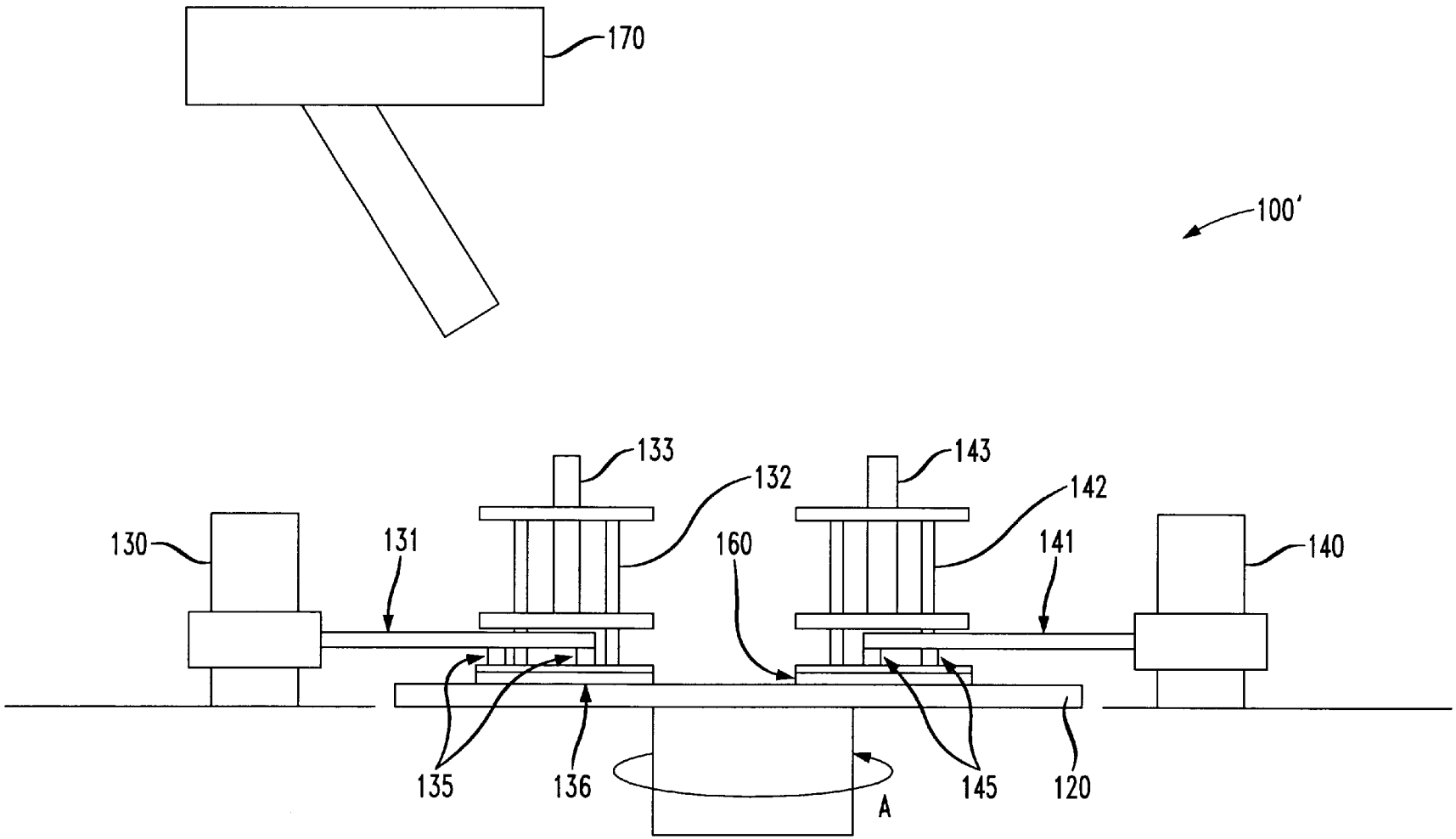
FIG. 6 is a side elevation view of the polishing apparatus shown in FIG. 5.

In operation, the wafers 160 are applied to the rotating polishing pad 120 to accomplish a polishing of the wafers. In FIG. 4, the vacuum chucks 142, 152 of the polishing stations 140, 150 are shown in a position such that the wafers 160 are lowered against the polishing pad 120. Additionally, the vacuum chuck 132 of the conditioning station 130 is shown in a lowered position and disposed against the polishing pad 120. As noted above, the slurry produced by the slurry dispenser 170 assists in the polishing process. It should be noted that in the exemplary embodiment of the present invention the slurry-producing device 170 is disposed at a position in between the conditioning station 130 and the polishing station 150. Thus, when slurry is dispensed by the slurry dispenser 170, it strikes the polishing pad 120 and immediately contacts the conditioning station 130. The vacuum chuck 132 of the conditioning station 130, which is in contact with the polishing pad 120, spreads out the droplets of slurry, which allows a more even polishing of the wafers 160 at the polishing stations 140, 150. In particular, the slurry hits the polishing pad 120 in droplet form at a radial position before the conditioning station 130. Then, as the polishing pad 120 rotates counter-clockwise (as shown by the arrows), the droplets of slurry are moved radially towards the conditioning station 130 and the associated vacuum chuck 132. When the droplets disposed on the polishing pad 120 come into contact with the vacuum chuck 132, they are spread out due to the collision. Thus, by the time the slurry reaches the polishing stations 140 and 150 it has already been spread out, and therefore the wafers 160 disposed at those positions are polished evenly. Alternatively, as shown in FIGS. 5 and 6 (polishing apparatus 100'), a conditioning pad 136 may be attached to the vacuum chuck 132 which serves to further condition the surface of the polishing pad 120 as well as spread out the slurry. It should be noted that the conditioning pad 136 may be coupled to the vacuum chuck through either a vacuum through the chuck, or through the use of an attachment means, such as for example, screws, or an adhesive means, such as for example, glue.

Thus, utilizing the above apparatus 100, a more even polishing of wafers 160 can be accomplished. By using the conditioning station 130 disposed in the path of the slurry, the slurry is transformed from droplet form to a spread out form before it reaches the wafers 160. Accordingly, the wafers 160 are polished evenly on all sides.

Although the invention has been described in terms of exemplary embodiments, it is not limited thereto. Rather, the appended claims should be construed broadly, to include other variants and embodiments of the invention which may be made by those skilled in the art without departing from the scope and range of equivalents of the invention.

What is claimed is:

1. An apparatus for polishing a workpiece comprising:

a polishing pad;

at least two polishing arms, each for holding a workpiece to be polished on the polishing pad;

at least one conditioning arm for conditioning the polishing pad; and, a slurry dispenser, said slurry dispenser being disposed between the at least two polishing arms and the at least one conditioning arm so that slurry dispensed by the slurry dispenser reaches the at least one conditioning arm before it reaches the at least two polishing arms, wherein the at least two polishing arms and the at least one conditioning arm each include at least one vacuum chuck coupled thereto, wherein the at least one vacuum chuck of the at least one conditioning arm assists in spreading out the slurry dispensed by the slurry dispenser.

2. The apparatus of claim 1, wherein the polishing pad spins counter-clockwise from the at least one conditioning arm towards the at least one polishing arm.

3. The apparatus of claim 1, further comprising:

a conditioning pad coupled to the at least one conditioning arm.

4. A semiconductor wafer polishing apparatus comprising:

a polishing pad;

at least two polishing arms for holding semiconductor wafers to be polished on the polishing pad;

at least one conditioning arm for conditioning the polishing pad; and, a slurry dispenser, said slurry dispenser being disposed between the at least two polishing arms and the at least one conditioning arm so that slurry dispensed by the slurry dispenser reaches the at least one conditioning arm before it reaches the at least two polishing arms wherein the at least two polishing arms and the at least one conditioning arm each include at least one vacuum chuck coupled thereto, wherein the at least one vacuum chuck of the at least one conditioning arm assists in spreading out the slurry dispensed by the slurry dispenser.

5. The apparatus of claim 4, wherein the polishing pad spins counter-clockwise from the at least one conditioning arm towards the at least one polishing arm.

6. The apparatus of claim 4, further comprising:

a conditioning pad coupled to the at least one conditioning arm.

* * * * *